US010121586B2

(12) United States Patent
Lee et al.

(10) Patent No.: US 10,121,586 B2
(45) Date of Patent: Nov. 6, 2018

(54) METHOD FOR MANUFACTURING FE-BASED AMORPHOUS METAL POWDER AND METHOD FOR MANUFACTURING AMORPHOUS SOFT MAGNETIC CORES USING SAME

(71) Applicant: AMOGREENTECH CO., LTD., Gimpo-si (KR)

(72) Inventors: Byoung Ki Lee, Gimpo-si (KR); Se Joong Yoon, Gimpo-si (KR); Mi Rae Kim, Gimpo-si (KR)

(73) Assignee: AMOGREENTECH CO., LTD., Gimpo-si (KR)

( * ) Notice: Subject to any disclaimer, the term of this patent is extended or adjusted under 35 U.S.C. 154(b) by 104 days.

(21) Appl. No.: 14/762,021

(22) PCT Filed: Jan. 21, 2014

(86) PCT No.: PCT/KR2014/000571
§ 371 (c)(1),
(2) Date: Jul. 20, 2015

(87) PCT Pub. No.: WO2014/116004
PCT Pub. Date: Jul. 31, 2014

(65) Prior Publication Data

US 2015/0357118 A1 Dec. 10, 2015

(30) Foreign Application Priority Data

Jan. 24, 2013 (KR) ..... 10-2013-0008068

(51) Int. Cl.
*B22F 3/00* (2006.01)
*H01F 41/02* (2006.01)
(Continued)

(52) U.S. Cl.
CPC ..... *H01F 41/0246* (2013.01); *B22F 1/0014* (2013.01); *B22F 3/006* (2013.01);
(Continued)

(58) Field of Classification Search
CPC ..... H01F 1/15341; H01F 41/0226; H01F 1/20
See application file for complete search history.

(56) References Cited

U.S. PATENT DOCUMENTS 5,252,148 A * 10/1993 Shigeta ..... C22C 45/02 148/305
5,635,828 A * 6/1997 Yoshizawa ..... H01F 1/15308 323/362
(Continued)

FOREIGN PATENT DOCUMENTS

JP 2010034102 2/2010
JP 2012204744 10/2012
(Continued)

OTHER PUBLICATIONS

International Search Report—PCT/KR2014/000571 dated Apr. 21, 2014.

*Primary Examiner* — Veronica F Faison
(74) *Attorney, Agent, or Firm* — Cantor Colburn LLP

(57) ABSTRACT

A manufacturing method of an amorphous soft magnetic core using a Fe-based amorphous metallic powder includes size-sorting an amorphous metallic powder obtained by pulverizing an amorphous ribbon prepared by a rapid solidification process (RSP) and then using the amorphous metallic powder having a particle size distribution so as to comprise 10 to 85 wt. % of powder having a particle size of 75 to 100 μm, 10 to 70 wt. % of powder having a particle size of 50 to 75 μm, and 5 to 20 wt. % of powder having a particle size of 5 to 50 μm to manufacture an amorphous soft
(Continued)

magnetic core with excellent high-current DC bias characteristic and good core loss characteristic.

6 Claims, 3 Drawing Sheets

(51) Int. Cl.

| | |
|---|---|
| ***B22F 9/00*** | (2006.01) |
| ***B22F 3/24*** | (2006.01) |
| ***H01F 1/147*** | (2006.01) |
| ***B22F 3/02*** | (2006.01) |
| ***B22F 9/04*** | (2006.01) |
| ***B22F 1/00*** | (2006.01) |
| *H01F 1/153* | (2006.01) |
| *C22C 33/02* | (2006.01) |

(52) U.S. Cl.
CPC ..... *B22F 3/02* (2013.01); *B22F 3/24* (2013.01); *B22F 9/008* (2013.01); *B22F 9/04* (2013.01); *H01F 1/14766* (2013.01); *B22F 2009/048* (2013.01); *B22F 2998/10* (2013.01); *C22C 33/0278* (2013.01); *C22C 2200/00* (2013.01); *C22C 2202/02* (2013.01); *H01F 1/15308* (2013.01)

(56) References Cited

U.S. PATENT DOCUMENTS

2004/0051614 A1* 3/2004 Kanekiyo ..... H01F 1/058
335/302
2004/0099346 A1* 5/2004 Nishiuchi ..... B82Y 25/00
148/302
2005/0028889 A1* 2/2005 Song ..... H01F 1/15341
148/104
2005/0034787 A1* 2/2005 Song ..... B22F 9/007
148/104
2007/0175545 A1* 8/2007 Urata ..... B22F 9/002
148/304
2007/0258842 A1* 11/2007 Lu ..... C22C 33/0257
419/10
2011/0080248 A1* 4/2011 Nishimura ..... B22F 1/0003
336/221
2013/0255836 A1* 10/2013 Otsuka ..... H01F 1/15308
148/304

FOREIGN PATENT DOCUMENTS

KR 1020050015563 2/2005
KR 1020050018235 2/2005

* cited by examiner

METHOD FOR MANUFACTURING FE-BASED AMORPHOUS METAL POWDER AND METHOD FOR MANUFACTURING AMORPHOUS SOFT MAGNETIC CORES USING SAME

TECHNICAL FIELD

The present invention relates to a manufacturing method of an amorphous soft magnetic core using a Fe-based amorphous metallic powder, and more particularly to a manufacturing method of a Fe-based amorphous metallic powder and a manufacturing method of an amorphous soft magnetic core using the same, where the Fe-based amorphous metallic powder is obtained by pulverizing a Fe-based amorphous ribbon prepared by a rapid solidification process (RSP) to acquire excellent high-current DC bias characteristic and good core loss characteristic.

BACKGROUND ART

Fe-based amorphous soft magnetic material is generally used as high-frequency soft magnetic materials have high saturation magnetic flux density (Bs) but exhibit low magnetic permeability, large magnetostriction and poor high-frequency characteristic, and Co-based amorphous soft magnetic materials have demerits such as low saturation magnetic flux density and high price due to their limit as a raw material. Further, amorphous soft magnetic alloys are difficult to process in the form of strips and give a limit to the shape of the products like toroidal shape, and ferrite soft magnetic materials exhibit low loss at high frequencies but are hard to process to a small size because of their low saturation magnetic flux density. Both the amorphous soft magnetic material and the ferrite soft magnetic material display poor reliability in the aspect of thermal stability due to their low crystallization temperature.

Currently, the soft magnetic core is obtained by winding an amorphous ribbon prepared through a RSP technique in the form of a core. In this case, the soft magnetic core exhibits considerably poor levels of DC bias characteristic and high-frequency magnetic permeability and has a relatively large core loss. The reason lies in the fact that the amorphous ribbon core has no air gap in the ribbon, while the powder core includes air gaps uniformly distributed between the powders. It is therefore preferable to use the powder core having air gaps uniformly distributed in order to obtain a core with excellent high-frequency magnetic permeability and core loss characteristic.

The soft magnetic core used in the choke coils for the purpose of reducing or smoothing electromagnetic noise is manufactured by coating a ceramic insulating material with a metallic magnetic powder, such as of pure iron, Fe—Si—Al alloy (hereinafter, referred to as "sandust"), Ni—Fe—Mo permalloy (hereinafter, referred to as "MPP (Moly Permally Powder)"), Ni—Fe permalloy (hereinafter, referred to as "high flux"), Fe-based amorphous powder core, nano-crystalline powder core, etc., adding a mold lubricant and then performing the subsequent steps of pressurization, molding and heat treatment.

In the conventional manufacturing method of a soft magnetic core, an insulating layer is formed between the powders to uniformly distribute air gaps, which can minimize the eddy current loss that abruptly increases at high frequencies and maintain the air gaps entirely to secure excellent high-current DC bias characteristic. For example, the pure iron powder core is used to reduce the electromagnetic noise that is biased by the high-frequency current in the choke coil of a switching mode power supply (SMPS) having a switching frequency of 50 KHz or below, and the sandust core is used as a core for the secondary smoothing choke coil of a SMPS having a switching frequency in the range of 100 KHz to 1 MHz and a core for noise reduction. In this regard, the term "DC bias characteristic" as used herein refers to the characteristic of a magnetic core with respect to the waveform in which the direct current (DC) is biased by a weak alternative current (AC) generated when the AC input of the power supply is converted to the DC. If the DC is biased by the AC, the magnetic permeability of the core drops in proportion to the DC. In this regard, the DC bias characteristic is evaluated in terms of the percentage of permeability (% μ; percent permeability) with the DC bias in relation to the permeability without the DC bias.

The MPP core and the high flux core, which are used in the same frequency range of the sandust core, may have more excellent DC bias characteristic and lower core loss than the sandust core but are expensive. Accordingly, there still remains a need to develop a core that is of low price but with equivalent levels of characteristics to the MPP or high flux core. In the meanwhile, it is more difficult to meet the requirements to the soft magnetic cores for such use purposes in terms of the characteristics associated with the recent trend towards the miniaturization, higher integration and higher reliability of the SMPS.

The core for smoothing choke coils in the SMPS is required to have appropriate inductance L, low core loss and excellent DC bias characteristic. To meet these requirements, Korean Patent No. 10-0545849 suggests a manufacturing method of an amorphous soft magnetic core using a composite powder comprising Fe-based amorphous powder of which the particle size distribution is controlled such that 34 to 45% of the powder passesthrough a 100 to +140 mesh sieve (107 to 140 μm) and 55 to 65% of the powder passes through a −140 to +200 mesh sieve (74 to 107 μm).

But, the particle size distribution adopted in the above patent composes the powder having a large particle size greater than 100 μm to be a great proportion in the composite powder, so there appear excessively large-sized pores between the powders. Particularly, in the case of amorphous powder, such a large pore size is not substantially reduced during the subsequent molding process in consideration of the fact that the amorphous powder is scarcely susceptible to plastic deformation under the molding pressure during the molding process. This can give a limit as to enhancing the DC bias characteristic. Further, an excess of pores between the powders results in the lower strength of the molded products, adversely affecting the handleability or workability of the products. Also, another problem lies in that an increase in the particle size of the powder increases the eddy current loss, which entirely makes it difficult to reduce the core loss to less than 1,000 mW/cm$^3$ (Refer to Table 1 in Korean Patent No. 10-0545849).

It is undesirable for the fine powder having an extremely small particle size to take a relatively large proportion and increase the hysteresis loss. Generally, the core loss can be divided into hysteresis loss and eddy current loss. The hysteresis loss represents a loss as much as the area of a magnetic hysteresis loop. The eddy current loss indicates a power loss as a result of the eddy current generated by the induced electromotive force. Such an eddy current loss can be represented by the following expression, which shows that the eddy current loss is proportional to the square of the particle thickness (diameter) in the core:

$$P_e(\text{eddy current loss}) = \frac{\pi^2 B^2 f^2 d^2}{C\rho}$$

$B$ = Flux Density, $f$ = Frequency, $d$ = thickness

Accordingly, reducing the particle size of the powder may entirely reduce the eddy current loss, but it can also reduce the magnetic permeability and increase the Hc of the magnetic hysteresis loop, leading to an increase in the hysteresis loss. It is therefore necessary to limit the content of the fine powder having a particle size less than 50 μm.

Moreover, Server PCs, Telecom Power, or the like are currently leading the industries of the switching mode power supply (SMPS) and the major SMPS makers are IBM, DELL, HP, etc. With the trends of PCs towards the higher capacity, higher quality and slimness, there has been a step change in the design specification of the power supply. First of all, the specifications of the CPU have a tendency to higher frequency and higher current, and therefore, the stable power supply has become a big issue. In addition, the capacity of the power supply has increased in accord to the trends of the PCs to the multi-functionality. Accordingly, the addition of a power-factor improvement circuit is now mandatory, and a power core with great current stability, frequency stability and low loss is demanded as a choke for high-performance PFC in order to minimize the increase in the volume of the power supply as a result of the addition of the power-factor improvement circuit. For the sake of meeting the practical demands, it is necessary to improve the magnetic characteristic of the soft magnetic core using the Fe-based amorphous powder suggested in Korean Patent No. 10-0545849 to the level as required in the market.

As a result of the mentioned studies on the manufacturing method of a Fe-based amorphous soft magnetic core on the above-described background, the inventors of the present invention have found out that the particle size distribution of the powder constituting the soft magnetic core can be efficiently controlled to the optimum to increase the molding density of themolded core material, enhance the high-current DC bias characteristic and improve the core loss characteristic, thereby completing the present invention.

DISCLOSURE OF INVENTION

It is therefore an object of the present invention to provide a manufacturing method of a Fe-based amorphous metallic powder and a manufacturing method of an amorphous soft magnetic core using the Fe-based amorphous metallic powder, where the Fe-based amorphous metallic powder uses a Fe-based amorphous metallic ribbon prepared by a rapid solidification process (RSP) to have air gaps uniformly distributed for the manufacture of an amorphous soft magnetic core with good DC bias characteristic, enhance the high-current DC bias characteristic and improve the core loss characteristic through a particle distribution construction excellent in formability.

To achieve the object of the present invention, there is provided a method for manufacturing an amorphous metallic powder that includes: preliminarily heat-treating a Fe-based amorphous metallic ribbon prepared by a rapid solidification process (RSP); pulverizing the amorphous metallic ribbon to obtain an amorphous metallic powder; and size-sorting the amorphous metallic powder and mixing the amorphous metallic powder into a composite powder with a particle size distribution comprising 10 to 85 wt. % of powder having a particle size of 75 to 100 μm, 10 to 70 wt. % of powder having a particle size of 50 to 75 μm, and 5 to 20 wt. % of powder having a particle size of 5 to 50 μm.

According to the present invention, the amorphous metallic powder is preferably used as a raw material to prepare a soft magnetic core with excellent DC bias characteristic.

According to the present invention, there is further provided a method for manufacturing an amorphous soft magnetic core that includes: preliminarily heat-treating a Fe-based amorphous metallic ribbon prepared by a rapid solidification process (RSP); pulverizing the amorphous metallic ribbon to obtain an amorphous metallic powder; size-sorting the amorphous metallic powder and mixing the amorphous metallic powder into a composite powder with a particle size distribution comprising 10 to 85 wt. % of powder having a particle size of 75 to 100 μm, 10 to 70 wt. % of powder having a particle size of 50 to 75 μm, and 5 to 20 wt. % of powder having a particle size of 5 to 50 μm; adding a binder to the composite powder and molding the composite powder to obtain a molded core material; and annealing the molded core material and then coating the molded core material with an insulating resin to obtain a soft magnetic core.

According to the present invention, the binder preferably comprises 0.5 to 3 wt. % of any one selected from phenol, polyimide, and epoxy.

According to the present invention, in order to acquire a desired magnetic characteristic, the annealing step is preferably performed at a temperature of 300 to 500° C. under the atmospheric condition for 0.3 to 4.3 hours.

Effects of the Invention

As described above, the present invention is to manufacture a soft magnetic core from an amorphous metallic powder obtained by using a Fe-based amorphous metallic ribbon as a starting material, which soft magnetic core exhibits excellent DC bias characteristic and low core loss in relation to the conventional Fe-based amorphous soft magnetic core.

In addition, the present invention involves composing an amorphous metallic powder to manufacture a soft magnetic core so as to have a specific particle size distribution, thereby advantageously making it possible to use the soft magnetic core in the wide range requiring good high-current DC bias characteristic that is under severe use conditions and also in the field of smoothing choke cores for switching mode powder supply (SMPS).

BEST MODES FOR CARRYING OUT THE INVENTION

Hereinafter, a detailed description will be given as to a manufacturing method of a Fe-based amorphous metallic powder and an amorphous soft magnetic core using the Fe-based amorphous metallic powder according to the present invention.

Figure 1:
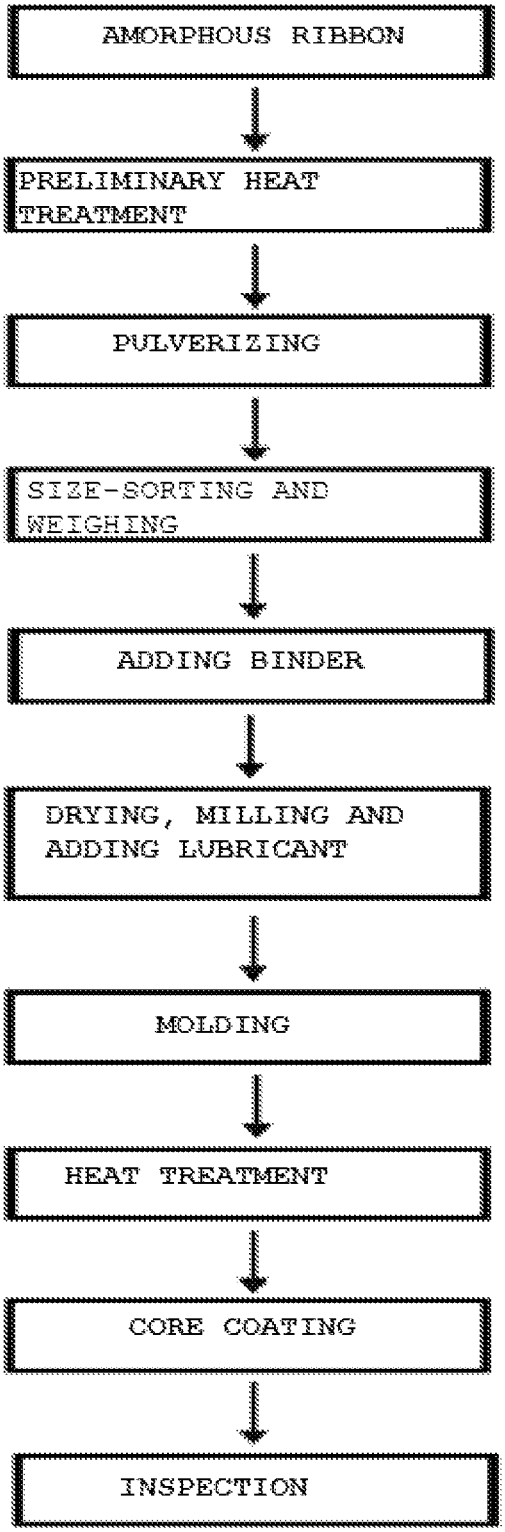
FIG. 1 is a schematic diagram showing the manufacturing process from the manufacture of an amorphous metallic powder according to the present invention to the molding of an inductor.

FIG. 1 is a schematic diagram showing the manufacturing process from the manufacture of an amorphous metallic powder according to the present invention to the molding of an inductor. Referring to FIG. 1, in order to obtain a Fe-based amorphous metallic powder, an amorphous metallic ribbon with a desired composition as prepared by a rapid solidification process (RSP) is preliminarily heat-treated at 100 to 400° C. under the atmospheric condition for about one hour and then subjected to a pulverization step.

After the preliminary heat treatment, the amorphous metallic ribbon is pulverized with a milling machine to obtain an amorphous metallic powder. During the pulverization step, the pulverizing speed and the pulverizing time are appropriately controlled to manufacture a powder that comes in different shapes and particle size distributions. Subsequently, the pulverized amorphous metallic powder is size-sorted into powders having a particle size of 75 to 100 μm, 50 to 75 μm, or 5 to 50 μm.

The desirable particle size distribution of the amorphous metallic powder used in the present invention is given such that the amorphous metallic powder comprises 10 to 85 wt. % of powder having a particle size of 75 to 100 μm, 10 to 70 wt. % of powder having a particle size of 50 to 75 μm, and 5 to 20 wt. % of powder having a particle size of 5 to 50 μm. This is a particle size composition for acquiring optimum physical characteristics and magnetic characteristics. With such a particle size composition, it is possible to obtain a molded core material having a good molding density of about 83 to 84 during the molding step.

The reason of determining such a particle size distribution in the present invention can be described in detail as follows.

Firstly, when the powder having a particle size of 75 to 100 μm is greater than 85%, the eddy current loss increases to deteriorate the core loss characteristic and lower the eddy current loss, but part of the powder may be crystallized during the step of pulverizing the ribbon to increase the hysteresis loss and deteriorate the core loss characteristic. When the powder having a particle size of 75 to 100 μm is less than 10%, the molding density is reduced to make an insignificant effect of improving the DC bias characteristic. When the powder having a particle size of 5 to 50 μm is greater than 20%, the hysteresis loss increases to remarkably deteriorate the core loss characteristic, making it impossible to acquire a desired magnetic permeability. When the powder having a particle size of 5 to 50 μm is less than 5%, fine cracks appear on the surface of the core after the molding step to lower the molding density, which makes it difficult to improve the DC bias characteristic.

In order to manufacture a soft magnetic core from the amorphous metallic powder prepared as described above, a binder, such as phenol, polyimide, epoxy, or water glass, is added in an amount of 0.5 to 3 wt. % with respect to the total weight of the amorphous metallic powder, and the mixture is then subjected to a drying step. The drying step is to eliminate the solvent used in mixing the amorphous metallic powder with phenol, polyimide, epoxy, water, or water glass.

Subsequent to the drying step, the powder is pulverized with a milling machine. After the milling, any one lubricant selected from Zn, ZnS, and stearate is added to the pulverized powder and the mixture is molded with a press under a molding pressure of about 20 to 26 ton/cm$^2$ to form a toroidal core. The lubricant is used to reduce the friction between the powers or between the molded material and the mold. Preferably, Zn-stearate generally used as a lubricant is added in an amount of less than 2 wt. % with respect to the total weight of the pulverized powder.

Subsequently, the toroidal core is subjected to a heat treatment (annealing) under the atmospheric condition at 300 to 500° C. for 0.3 to 4.3 hours to eliminate the residual stress and deformation and then coated with a polyester or epoxy resin in order to protect the core characteristics against moisture or air, thereby completing a soft magnetic core. In this regard, the thickness of the epoxy resin coating is preferably about 50 to 200 μm.

EXAMPLES

Hereinafter, the present invention will be described in further detail with reference to Examples.

Examples 1 to 4

A Fe78-Si13-B9 amorphous metallic ribbon prepared by a rapid solidification process (RSP) is subjected to a one-hour preliminary heat treatment at 300° C. under the atmospheric condition. The amorphous metallic ribbon thus obtained is pulverized with a milling machine to obtain an amorphous metallic powder. The amorphous metallic powder is size-sorted and mixed so as to have a particle size distribution as presented in Table 1 according to the present invention, thereby preparing a composite powder of amorphous metals. In this regard, the unit % means wt. %.

The composite powder thus obtained is mixed with 2.0 wt. % of water glass and then dried out. After the drying step, the lump of powder is pulverized again with a ball mill and then mixed with 0.5 wt. % of Zn-stearate. The mixture is molded under the molding pressure of 22 ton/cm$^2$ with a core mold to complete a toroidal core as a molded material.

Subsequently, the molded core material is annealed at 450° C. for 30 minutes and then coated with an epoxy resin in thickness of 100 μm to manufacture a soft magnetic core. The soft magnetic core thus obtained is measured in regards to magnetic permeability, DC bias characteristic, and core loss characteristic. The measurement results are presented in Table 1.

TABLE 1

Magnetic characteristics of soft magnetic core according to the present invention.

| Div. | Example 1 | Example 2 | Example 3 | Example 4 |
|---|---|---|---|---|
| 75~100 μm(wt. %) | 70 | 85 | 40 | 60 |
| 50~75 μm(wt. %) | 20 | 10 | 50 | 20 |
| 5~50 μm(wt. %) | 10 | 5 | 10 | 20 |
| Permeability (μ) | 60 | 60 | 60 | 60 |
| Molding density (%) | 84 | 83 | 83 | 83 |
| DC bias characteristic (% μ) | 74 | 73 | 73 | 73 |
| Core loss (mW/cm$^3$) | 700 | 750 | 800 | 750 |
| Surface cracks | x | x | x | x |

As for the permeability (μ) in Table 1, an enameled copper wire is wound around the soft magnetic core 30 times, and the inductance L (μH) is measured with a precise LCR meter. The inductance L is applied to the relational expression of the toroidal core as given by $(0.4\pi N^2 A\times10^{-2})/l$ (where N is the number of winding frequencies; A is a cross-sectional area of the core; and l is the average length of the magnetic path) to determine the magnetic permeability (μ). The measurement is carried out under the conditions including frequency of 100 kHz and AC voltage of 1V, without DC bias ($I_{DC}$=0 A). Further, the change of permeability is measured while varying the DC current to evaluate the DC bias characteristic. The measurement conditions are the frequency of 100 kHz, AC voltage of 1V, and the intensity of magnetization (100 Oe) given by $H_{DC}=0.4\pi NI/l$, where I is the peak magnetization current. The core loss is measured with a B-H analyzer, while the numbers of the primary and secondary windings are 30 times and 5 times, respectively.

It can be seen from the measurement results for the Examples 1 to 4 of the present invention in Table 1 that the soft magnetic core manufactured by controlling the particle size distribution of the amorphous powder within a defined range according the present invention can acquire effects of improving the surface conditions of the core, enhancing the DC bias characteristic and reducing the core loss.

For a comparison with the present invention, there is used a prior art material (Korean Patent No. 10-0545849), which is an amorphous soft magnetic core manufactured by using an amorphous powder of the same constituent components of the Examples at a mixing ratio so as to comprise 40% of powder having a particle size of 100 to 150 μm and 60% of powder having a particle size of 75 to 100 μm. The prior art material is measured in regards to the magnetic characteristics under the same measurement conditions of the Examples of the present invention. The measurement results are presented in Table 2.

TABLE 2

Comparison of characteristics between the present invention and the prior art material.

| | Permeability (μ) (100 KHz, 1 V) | DC bias characteristic (% μ) (100 Oe) | Core loss (mW/cm$^3$) (100 KHz, 0.1 T) |
|---|---|---|---|
| Prior art | 60 | 65 | 1000 |
| Example 1 | 60 | 74 | 700 |
| Example 2 | 60 | 73 | 750 |
| Example 3 | 60 | 73 | 800 |
| Example 4 | 60 | 73 | 750 |

As can be seen from Table 2, relative to the prior art material, the soft magnetic core of the present invention is improved in the DC bias characteristic and the core loss. In other words, the present invention controls the particle size distribution of the amorphous metallic powder to increase the content of the powder having a relatively small particle size and then enhance the insulating effect caused by the binder on the surface of the powder, thereby reducing the magnetic flux leakage (MFL), fills the large pores between the powders with fine powder to eliminate the large pores in the molded material, and has the micro pores uniformly distributed to improve the DC bias characteristic and reduce the eddy current loss, which leads to the enhanced core loss.

Figure 2:
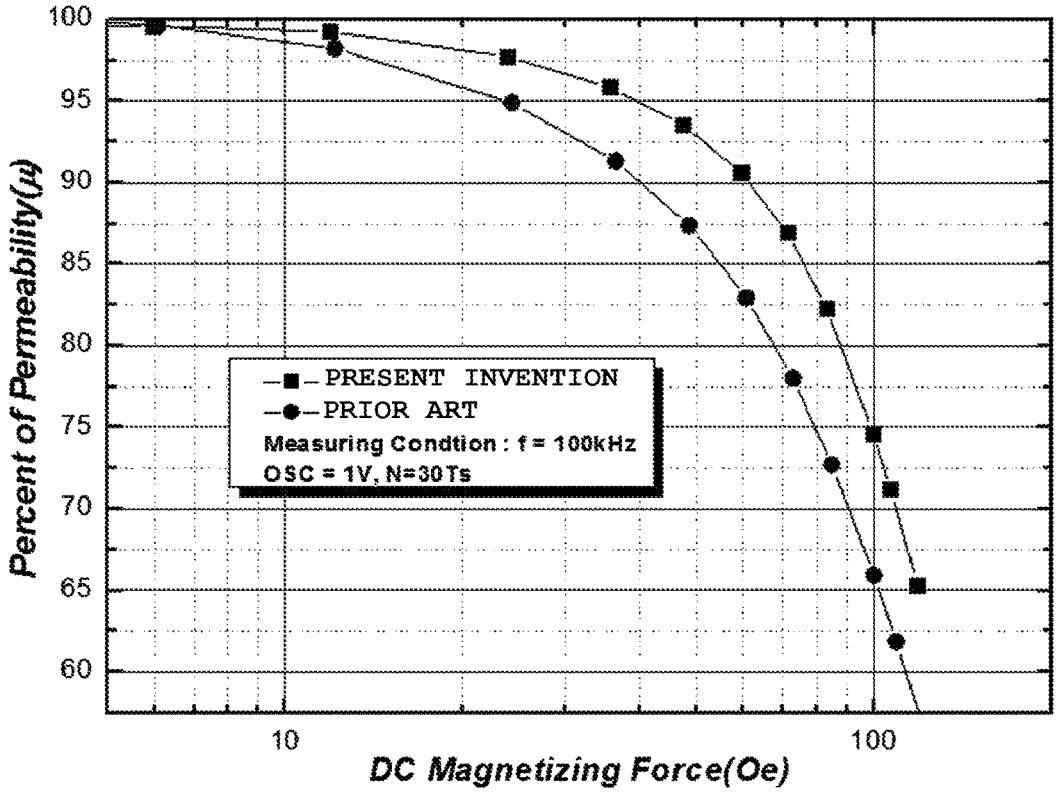
FIG. 2 is a graph showing a comparison of the change in DC bias characteristic between the soft magnetic core prepared according the present invention and the prior art material.
Figure 3:
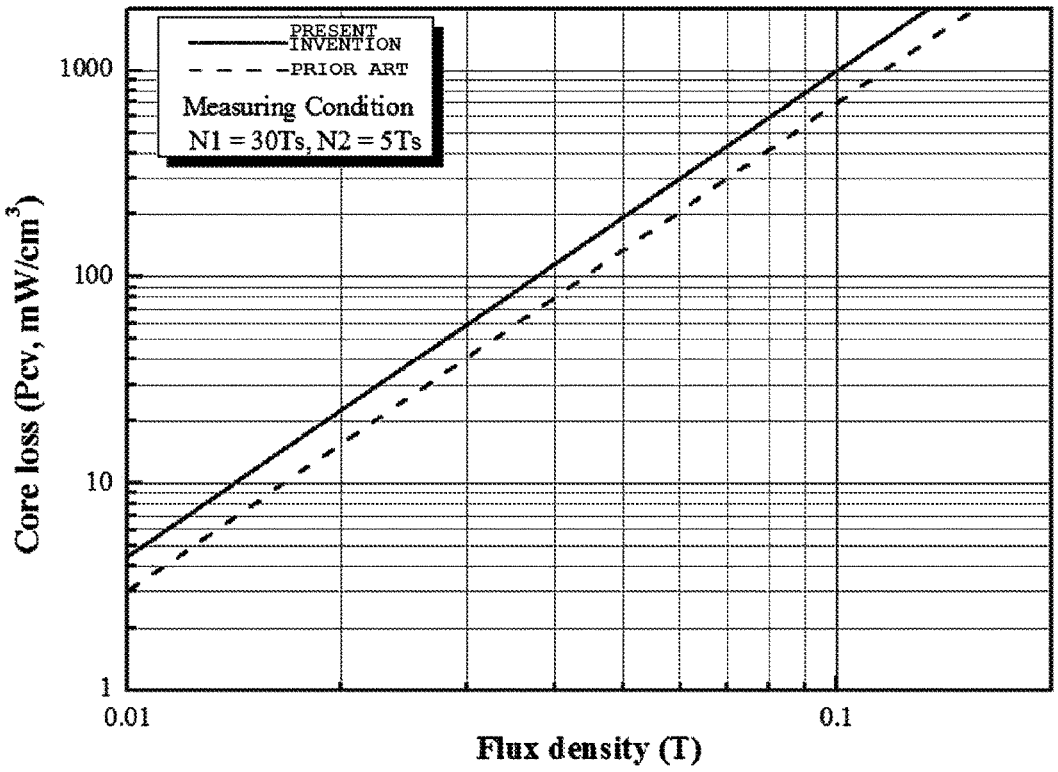
FIG. 3 is a graph showing a comparison of the core loss at 100 kHz between the soft magnetic core prepared according to the present invention and the prior art material.

FIG. 2 is a graph showing the change of permeability with DC bias at 100 kHz and 1 V for the Example 1 (novel material) of the present invention and the prior art material as presented in Table 2. As can be seen from FIG. 2, the novel material (■) that is the soft magnetic core manufactured according to the present invention is superior in the DC bias characteristic to the prior art material (●). In other words, the change in the particle size distribution of the amorphous powder according to the present invention makes an effect to improve the DC bias characteristic by about 8 to 10% (based on 100 Oe) in relation to the prior art material. Besides, the graph of FIG. 3 that represents the core loss at 100 kHz for the soft magnetic core of the present invention and the prior art material shows that the novel material of the present invention (dotted line) is considerably improved in the core loss characteristic relative to the prior art material (solid line).

In order to evaluate the change in the characteristics as a function of the change in the particle size distribution, the composite amorphous powder is composed so as to have the particle size distribution out of the defined range of the present invention in the test for characteristics.

Comparative Example 1

The procedures are performed in the same manner as described in Example 1 to manufacture a soft magnetic core, excepting that the amorphous powder has a particle size distribution so as to comprise 90% of powder having a particle size of 75 to 100 μm, 5% of powder having a particle size of 50 to 75 μm, and 5% of powder having a particle size of 5 to 50 μm.

Comparative Example 2

The procedures are performed in the same manner as described in Example 1 to manufacture a soft magnetic core, excepting that the amorphous powder has a particle size distribution so as to comprise 5% of powder having a particle size of 75 to 100 μm, 75% of powder having a particle size of 50 to 75 μm, and 20% of powder having a particle size of 5 to 50 μm.

Comparative Example 3

The procedures are performed in the same manner as described in Example 1 to manufacture a soft magnetic core, excepting that the amorphous powder has a particle size distribution so as to comprise 20% of powder having a particle size of 75 to 100 μm, 75% of powder having a particle size of 50 to 75 μm, and 5% of powder having a particle size of 5 to 50 μm.

Comparative Example 4

The procedures are performed in the same manner as described in Example 1 to manufacture a soft magnetic core, excepting that the amorphous powder has a particle size distribution so as to comprise 80% of powder having a particle size of 75 to 100 μm, 5% of powder having a particle size of 50 to 75 μm, and 15% of powder having a particle size of 5 to 50 μm.

Comparative Example 5

The procedures are performed in the same manner as described in Example 1 to manufacture a soft magnetic core, excepting that the amorphous powder has a particle size distribution so as to comprise 60% of powder having a particle size of 75 to 100 μm, 15% of powder having a particle size of 50 to 75 μm, and 25% of powder having a particle size of 5 to 50 μm.

Comparative Example 6

The procedures are performed in the same manner as described in Example 1 to manufacture a soft magnetic core, excepting that the amorphous powder has a particle size distribution so as to comprise 60% of powder having a particle size of 75 to 100 μm, 38% of powder having a particle size of 50 to 75 μm, and 2% of powder having a particle size of 5 to 50 μm.

The individual soft magnetic cores obtained in the Comparative Examples are measured in regards to the core permeability, DC bias characteristic, core loss, and the existence of surface cracks. The measurement results are presented in Table 3 together with the results of Example 1.

TABLE 3

| | Comparative Example | | | | | | |
|---|---|---|---|---|---|---|---|
| Div. | 1 | 2 | 3 | 4 | 5 | 6 | 7 |
| 75~100 μm (%) | 90 | 5 | 20 | 80 | 60 | 60 | 70 |
| 50~75 μm (%) | 5 | 75 | 75 | 5 | 15 | 38 | 20 |
| 5~50 μm (%) | 5 | 20 | 5 | 15 | 25 | 2 | 10 |
| Permeability (μ) | 60 | 51 | 60 | 60 | 49 | 60 | 60 |
| Molding density (%) | 81 | 82 | 82 | 80 | 82 | 81 | 84 |
| DC bias characteristic (%) | 66 | 68 | 70 | 65 | 68 | 66 | 70 |
| Core loss ($mW/cm^3$) | 1,000 | 800 | 950 | 800 | 1,050 | 700 | 700 |
| Surface cracks | ○ | X | X | ○ | X | ○ | X |

Referring to Table 3, when the powder having a particle size of 75 to 100 μm is less than 10% or greater than 85%, fine cracks appear on the surface of the molded core material, or there is no effect to improve the magnetic characteristics, causing deterioration in the magnetic permeability and core loss characteristic. Further, when the powder having a particle size of 50 to 75 μm is less than 10% or greater than 70%, fine cracks appear on the surface of the molded core material, or there is only a little effect to improve the DC bias characteristic or the core loss characteristic. In addition, when the powder having a particle size of 5 to 50 μm is less than 5% or greater than 20%, a desired magnetic permeability cannot be acquired, and only a slight effect is made to improve the DC bias characteristic appears insignificantly.

More specifically, the Comparative Example 1 has fine cracks on the surface of the core, has no improvement in the core loss characteristic and displays no improvement in the DC bias characteristic due to the low molding density.

As for the Comparative Example 2, the magnetic permeability is about 51μ, which is lower than the magnetic permeability of the core according to the Example 1 of the present invention by about 15%. It is therefore considered that a desired magnetic permeability cannot be acquired with such a particle size distribution of the metallic powder.

As for the Comparative Example 3, the magnetic permeability and the DC bias characteristic may be good to some degree, but the stress caused during the step of pulverizing the ribbon into powder increases the hysteresis loss, which means that it is substantially difficult to improve the core loss characteristic. The Comparative Example 4 creates fine cracks on the surface of the core and acquires a molding density of 80%, which also means that the DC bias characteristic is substantially difficult to improve.

As for the Comparative Example 5, the magnetic permeability is about 49μ, which is lower than the magnetic permeability of the core according to the Example 1 of the present invention by about 19%. Also, the core loss characteristic is deteriorated to 1,050 $mW/cm^3$ in relation to the prior art conditions because of the increased content of the amorphous powder already under crystallization. It is therefore considered that such a particle size distribution of the metallic powder can result in neither a desired level of magnetic permeability nor a desired magnetic characteristic. As for the Comparative Example 6, fine cracks appear on the surface of the core, and the molding density is reduced to 81%, which means that it is impossible to make an effect of improving the DC bias characteristic.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

INDUSTRIAL APPLICABILITY

The present invention relates to a manufacture of an amorphous soft magnetic core using a Fe-based amorphous metallic powder, to acquire an excellent high-current DC bias characteristic and a good core loss characteristic, and this invention will be used for an amorphous soft magnetic core.

What is claimed is:

1. A method for manufacturing an amorphous soft magnetic core, comprising:

preparing a composite powder;

adding a binder to the composite powder and molding the composite powder and the binder to obtain a molded core material; and annealing the molded core material, wherein the preparing consists of:

preparing a Fe-based amorphous metallic ribbon;

pulverizing the amorphous metallic ribbon to obtain an amorphous metallic powder;

size-sorting the amorphous metallic powder to obtain size-sorted amorphous metallic powders; and mixing, among the size-sorted amorphous metallic powders, a size-sorted amorphous metallic powder having a particle size of 5 to 100 μm to obtain the composite powder, wherein the composite powder consists of: 40 to 85 wt. % of powder having a particle size of 75 to 100 μm, 10 to 50 wt. % of powder having a particle size of 50 to 75 μm, and 5 to 20 wt. % of powder having a particle size of 5 to 50 μm.

2. The method as claimed in claim 1, wherein the binder comprises 0.5 to 3 wt. % of any one selected from the group consisting of phenol, polyimide, and epoxy.

3. The method as claimed in claim 1, wherein the annealing is performed at a temperature of 300 to 500° C. under an atmospheric condition for 0.3 to 4.3 hours.

4. A method for manufacturing an amorphous metallic powder for an amorphous soft magnetic core, consisting of:

preliminarily heat-treating a Fe-based amorphous metallic ribbon prepared by a rapid solidification process (RSP);

pulverizing the amorphous metallic ribbon to obtain an amorphous metallic powder; and size-sorting the amorphous metallic powder to obtain size-sorted amorphous metallic powders; and mixing, among the size-sorted amorphous metallic powders, a size-sorted amorphous metallic powder having a particle size of 5 to 100 μm to obtain a composite powder, wherein the composite powder consists of: 40 to 85 wt. % of powder having a particle size of 75 to 100 μm, 10 to 50 wt. % of powder having a particle size of 50 to 75 μm, and 5 to 20 wt. % of powder having a particle size of 5 to 50 μm.

5. The method as claimed in claim 4, wherein the amorphous metallic powder is used for a soft magnetic core having an improved DC bias characteristic.

6. The method as claimed in claim 1, after the annealing, further comprising: coating the molded core material with an insulating resin.

* * * * *